United States Patent [19]

Yee

[11] Patent Number: 4,924,041

[45] Date of Patent: May 8, 1990

[54] UNIVERSAL CIRCUIT BREAKER INTERLOCK ARRANGEMENT

[75] Inventor: Edgar Yee, Vernon, Conn.

[73] Assignee: General Electric Company, New York, N.Y.

[21] Appl. No.: 343,308

[22] Filed: Apr. 26, 1989

[51] Int. Cl.[5] ..... H01H 9/26

[52] U.S. Cl. ..... 200/50 C

[58] Field of Search ..... 200/5 B, 5 E, 5 EA, 200/5 EB, 50 C, 330

[56] References Cited

U.S. PATENT DOCUMENTS

| | | | |
|---|---|---|---|
| 2,080,964 | 5/1937 | Forstrom | 200/50 C |
| 2,557,351 | 6/1951 | Jacobson | 200/50 C X |
| 3,171,920 | 3/1965 | Klein et al. | 335/69 |
| 3,206,585 | 9/1965 | Gryctko | 200/330 |
| 3,312,797 | 4/1967 | Harrington et al. | 200/50 C |
| 3,319,020 | 5/1967 | Shaffer | 200/50 C |
| 3,369,100 | 2/1968 | Kussy et al. | 200/50 C X |
| 3,722,313 | 3/1973 | Schadow | 200/5 E X |
| 3,778,633 | 12/1973 | DeVisser et al. | 307/64 |
| 4,295,054 | 10/1981 | Kovatch et al. | 307/80 |
| 4,827,089 | 5/1989 | Morris et al. | 200/50 C |

*Primary Examiner*—J. R. Scott

*Attorney, Agent, or Firm*—Richard A. Menelly; Walter C. Bernkopf; Fred Jacob

[57] ABSTRACT

A universal circuit breaker interlock arrangement allows two circuit breakers to be interlocked such that only one of the circuit breakers is on at one time. The circuit breakers can be interlocked, per se, or when used with an electrical motor operator or with a manual rotary operator. The slidably mounted interlock arrangement also allows interlock function between two electric switches as well as between an electric switch.

11 Claims, 3 Drawing Sheets

FIG. 4
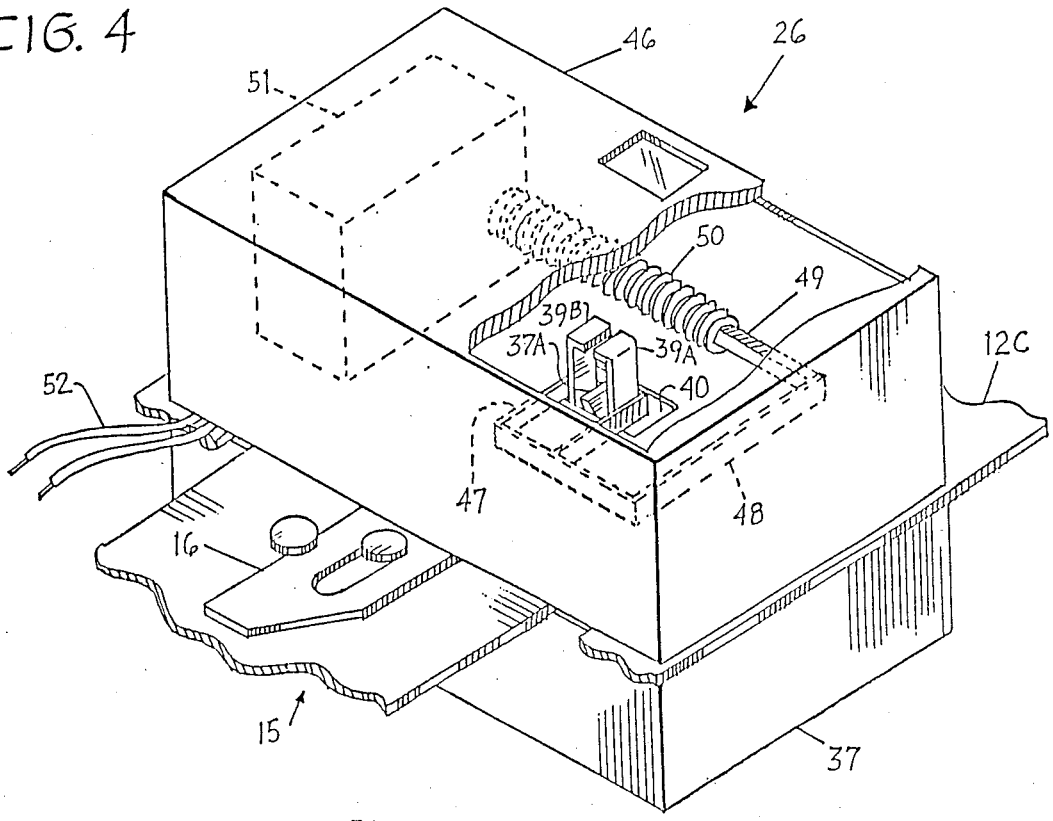
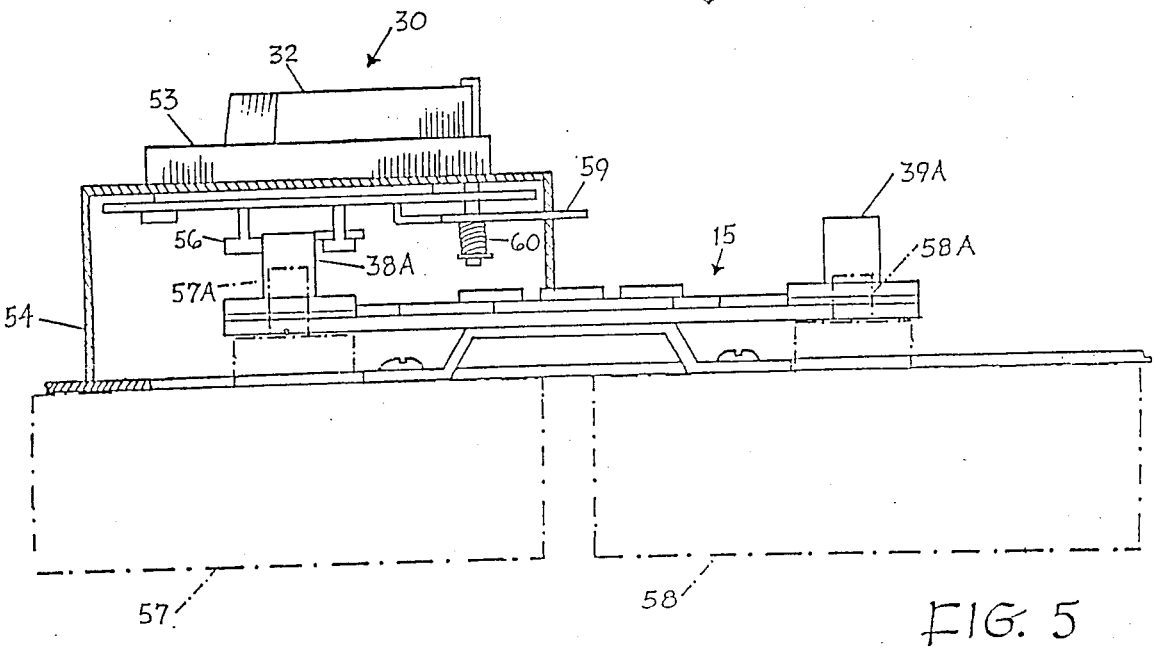
FIG. 5

UNIVERSAL CIRCUIT BREAKER INTERLOCK ARRANGEMENT

BACKGROUND OF THE INVENTION

When a pair of circuit breakers are connected to separate power systems, it is critical that both power systems are not connected to a common load at the same time. This is especially true, for example, when a utility power source is conneeted to a load through a first circuit breaker and an auxiliary power supply, such as a local generator, is connected to the same load through a second circuit breaker. Interlock devices are required which will allow only one of the interlocked circuit breakers to be on the ON condition such that the other circuit breaker must remain in its OFF position. Such interlock arrangements are also used with electric switches for essentially the same purpose.

U.S. Pat. No. 3,319,020 describes a sliding interlock arrangement for preventing one circuit breaker from being turned ON while the other circuit breaker is in its ON position. U.S. Pat. No. 3,312,797 describes a cam interlock arrangement for interlocking between a pair of circuit breakers connecting with a common load. U.S. Pat. No. 3,778,633 is an example of a "walking beam" interlock arrangement where the circuit breaker operating mechanisms are interlocked rather than the circuit breaker operating handles. U.S. patent application Ser. No. 205,894 filed June 13, 1988 now U.S. Pat. No. 4,827,089 entitled "Molded Case Circuit Breaker Interlock Arrangement" describes a pair of molded case circuit breakers that are interlocked by means of the operating mechanism crossbars to insure that only one of the interlocked circuit breakers can be turned on at one time.

Circuit breakers are also operated from a remote location by means of a motor operator whereby a remote switch connects to the motor operator that is arranged on the surface of a cabinet-mounted circuit breaker. The aforementioned interlock arrangements do not readily provide means for interlocking between a pair of circuit breakers when one of the circuit breakers is controlled by a remote motor operator such as that described within U.S. Pat. No. 3,171,920. U.S. Pat. No. 3,778,633 describes a specific interlock arrangement for a pair of motor operators, each motor operator controlling a separate one of a pair of circuit breakers.

A rotary switch operator is a device that is mounted on the handle of a circuit breaker or electric switch to transfer the ON - OFF motion of the circuit breaker handle from transilational to rotary operation. U.S. Pat. No. 3,206,585 describes one such rotary switch operator. The aforementioned U.S. patents that represent the state of the art of interlock devices do not readily provide for interlocking between a pair of circuit breakers when one of the circuit breakers supports a motor operator device. U.S. Pat. No. 4,295,054 describes an interlock arrangement used with a pair of circuit breakers wherein each circuit breaker supports a rotary switch operator.

One purpose of the instant invention is to provide a universal interlock arrangement for conveniently interlocking between circuit breakers and electric switches when either of the circuit breakers or electric switches is controlled by a motor operator or a rotary switch operator.

SUMMARY OF THE INVENTION

A universal interlock arrangement whereby a trapezoidal slide is arranged between a pair of latches that slidably interact with adjoining circuit breaker handles to insure that one circuit breaker handle remains in the OFF position when the other circuit breaker is turned ON. The interlock further accommodates a motor operator associated with a circuit breaker operating handle as well as a rotary switch operator associated with the circuit breaker operating handle.

BRIEF DESCRIPTION OF THE DRAWINGS

FIG. 4 is a top perspective view of a motor operator arranged on the interlock arrangement depicted in FIG. 1; and FIG. 5 is an end view of a rotary handle operator used with the interlock arrangement depicted in FIG. 1.

DESCRIPTION OF THE PREFERRED EMBODIMENT

Figure 1:
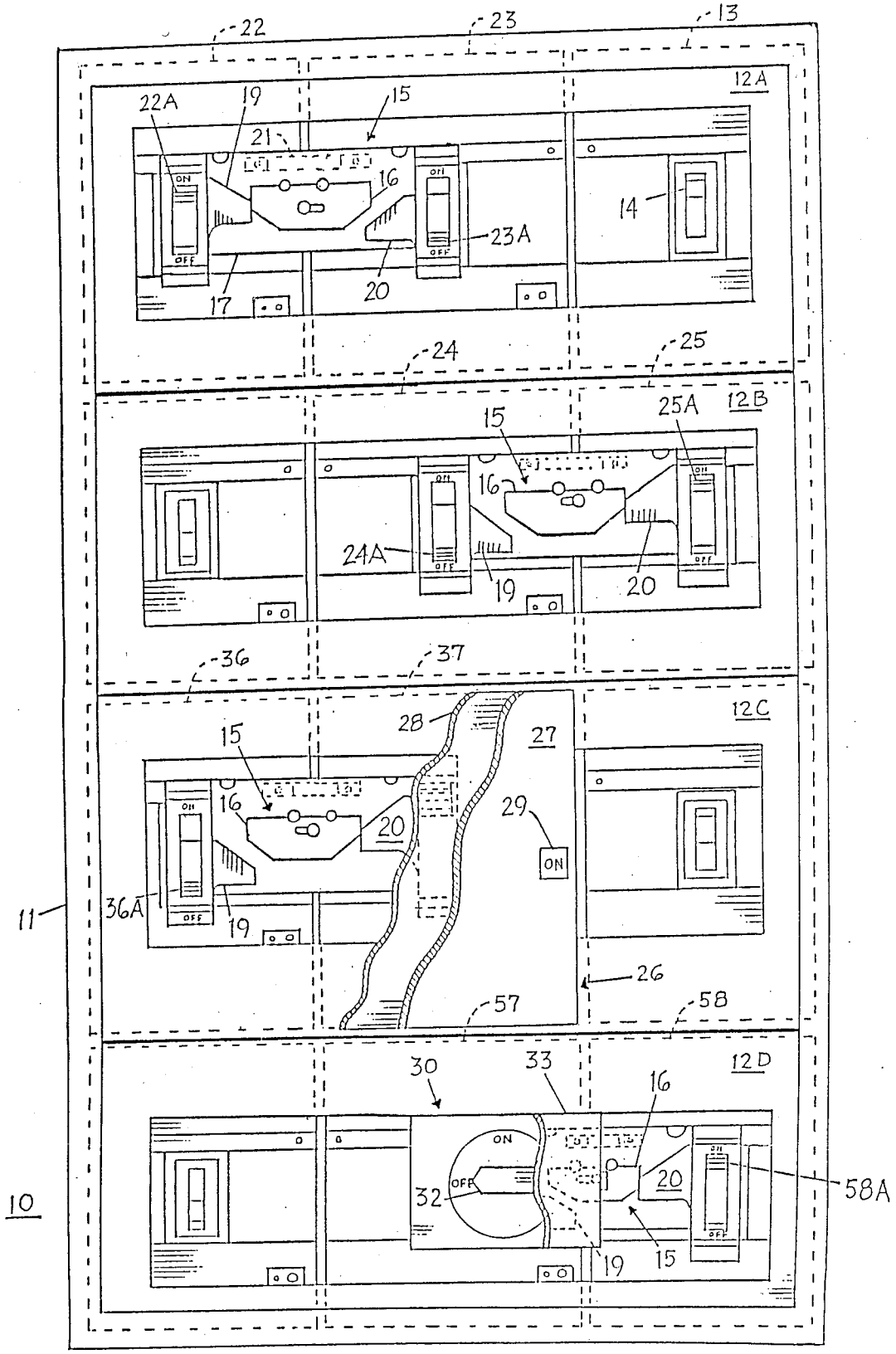
FIG. 1 is a front view of a circuit breaker panel depicting various applications of the interlock arrangement according to the invention.

A circuit breaker panelboard enclosure 10 is shown in FIG. 1 to consist of a metallic housing 11 within which a plurality of face plates 12A–12D are arranged. The face plates cover the circuit breakers contained therein such as the main circuit breaker 13 through which the operating handle 14 projects for providing external access to the circuit breaker. The panelboard can also contain electric switches, per se, or electric switches along with circuit breakers. The interlock arrangement 15, in accordance with the teachings of the invention, includes a support plate 17 upon which a trapezoidal slide 16 is mounted for movement between a pair of latch plates 19 and 20. The latch plates are movably supported on a corresponding branch breaker 22 on top of the branch breaker operating handle 22A and on an auxiliary branch breaker 23, hereafter "Auxiliary Breaker", on top of the auxiliary breaker handle 23A. The interlock is fastened between the branch and auxiliary breakers by means of a support bracket 21. The branch breaker 22 behind the face plate 12A is in the "ON" condition whereas the auxiliary breaker 23 is in the "OFF" condition. Any attempt to turn the auxiliary breaker to the ON condition would be thwarted by contact between the latch 20 and the trapezoidal slide 16 due to the interference between the corresponding latch 19 on the opposite side of the trapezoidal slide. The branch breaker 24 and auxiliary breaker 25 arranged behind face plate 12B are interlocked opposite to those shown earlier in FIG. 12A. The branch breaker 24 is in the OFF position as indicated by the branch breaker handle 24A and the associated latch 19. The auxiliary breaker 25 is in the ON condition as indicated by the auxiliary breaker handle 25A and associated latch 20. The interference between latch 20 and the trapezoidal slide 16 on the interlock would cause the latch 19 to become stopped against the opposite side of the trapezoidal slide 16 should an attempt be made to move the branch circuit breaker handle 24A to its ON position. A branch circuit breaker 36 and an auxiliary breaker 37 are arranged behind face plate 12C with the auxiliary breaker being controlled by a motor operator 26. The cover 27 and base plate 28 of the motor operator are removed to show the interlock arrangement 15 positioned such that the branch breaker handle 36A is kept in the OFF position by means of the arrangement between the associated latch 19 and the trapezoidal slide 16 and the latch 20 associated with the auxiliary breaker 37. The motor operator is in its ON position as depicted within the indicating window 29. A branch breaker 57 and an auxiliary breaker 58 are arranged behind the face plate 12D with the branch breaker controlled by means of a manual operator 30. The operating handle 32 of the manual operator 30 is in the OFF position such that the associated branch circuit breaker 57 located behind the base plate 33 of the manual operator is in its OFF position. The interlock arrangement 15 positions the associated latch 19, trapezoidal slide 16 and opposite latch 20 such that the operating handle 58A of the auxiliary breaker remains in its ON condition and prevents the handle 32 of the manual operator from being rotated to its ON position until and unless the auxiliary breaker 58 is turned OFF.

Figure 2:
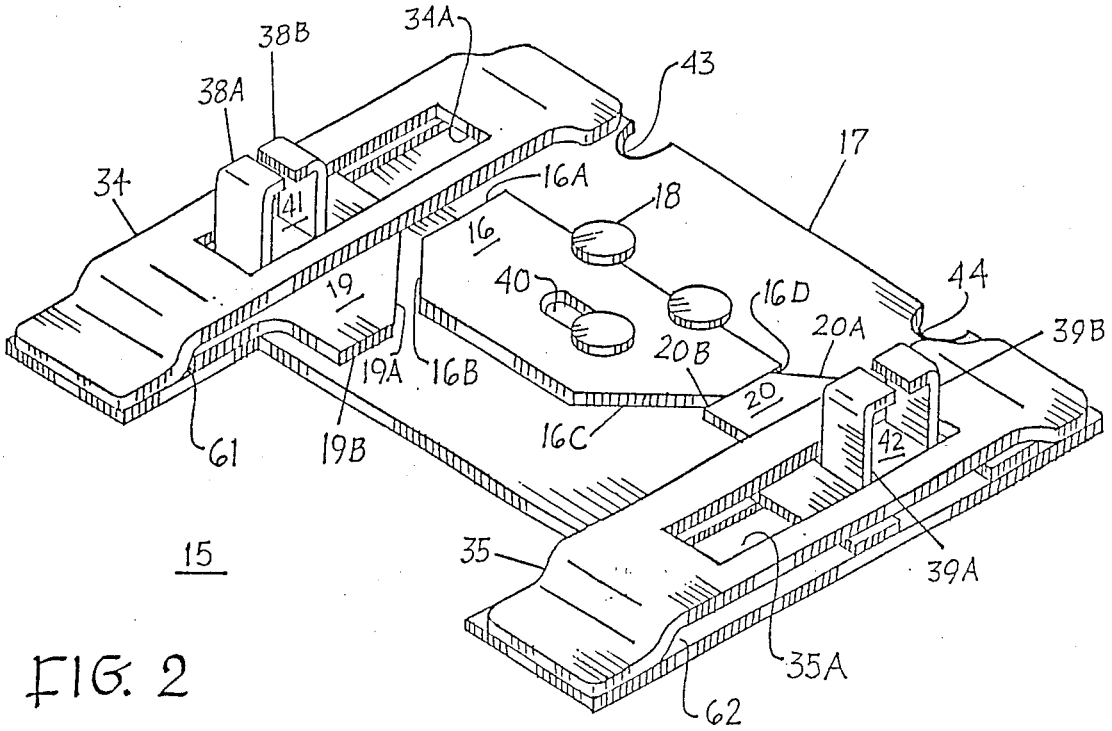
FIG. 2 is an enlarged top perspective view of the interlock arrangement shown in FIG. 1.
Figure 3:
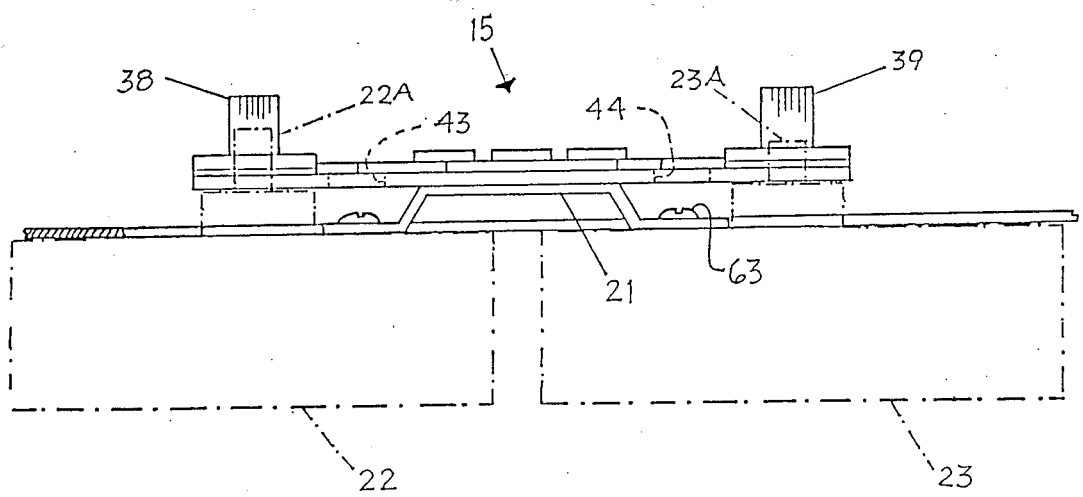
FIG. 3 is an end view of the interlock arrangement depicted in FIG. 2.

The interlock arrangement 15 shown in FIG. 2 consists of a planar metal base plate 17 with the planar trapezoidal slide 16 slidably positioned thereon by means of three radial guides 18 and the horizontal slot 40. Tapered edges 16B, 16C and opposing horizontal edges 16A, 16D interact with the tapered and horizontal edges 19A, 19B on latch 19 and with the tapered and horizontal edges 20A, 20B on latch 20 to hold the latches in either ON or OFF positions. Latch 19 includes a pair of upstanding angulated posts 38A, 38B which define a space 41 for receiving the operating handle of a circuit breaker or an electric switch. The latch is positioned within an elongated space 61 defined between the support plate 17 and a shaped top piece 34 which is end-welded to the support plate. The angulated posts 38A, 38B slide within an elongated slot 34A formed within the top piece 34. The latch 20 includes a similar pair of upstanding angulated posts 39A, 39B that define a similar space 42 for receiving the operating handle of another circuit breaker or electric switch. The latch 20 is slidingly retained within an elongated space 62 formed between a similar shaped top piece 35 that is edge-welded to the support plate 17. The upstanding angulated posts 39A, 39B move within a similar slot 35A formed within the shaped top piece 35. The semicircular slots 43, 44 formed on one side of the support plate provide access to a screw driver (not shown) for fastening the interlock 15 to the associated circuit breakers 22, 23 by means of bracket 21 and screws 63 as best seen by referring now to FIG. 3. The operating handles 22A, 23A on the associated circuit breakers 22, 23 are shown trapped behind the respective angulated posts 38, 39.

The motor operator 26 associated with the branch circuit breaker 36 and auxiliary breaker 37 of FIG. 1 is shown in FIG. 4 in greater detail. The motor operator, which is more fully described in the aforementioned U.S. Pat. No. 3,171,920, contains a motor 51 that connects with a remote switch by means of a pair of wire conductors 52. A gear shaft 50 extending from the motor terminates in a rectangular rod 49 to which an angular arm 48 and yoke 47 are attached. A part of the cover 46 is removed to show the circuit breaker handle 37A, on the circuit breaker 37 located behind the face plate 12C, extending upwards through a slot 40 formed in the bottom surface of the motor operator and captured between the upstanding angulated posts 39A, 39B located on the interlock arrangement 15. Upon energizing the motor 51, the yoke 47 drives the angulated posts 39A, 39B and the associated circuit breaker handle 37A within slot 40 provided that the circuit breaker operating handle is not interlocked by means of the trapezoidal slide 16.

The manual operator 30 depicted earlier in FIG. 1 is shown in FIG. 5 to detail the arrangement of the rotary operator handle 32 located within the circumferential skirt 53 formed on the housing 54 with respect to the associated branch circuit breaker 57 and circuit breaker operating handle 57A. The manual operator 30 is positioned over the interlock arrangement 15 such that the yoke 56 associated with the manual operator handle 32 traps the pair of angulated posts 38A, 38B, only one of which 38A is shown, which in turn contain the circuit breaker operating handle 57A. The clutch plate 59 which is spring-loaded against the housing 54 by means of the clutch plate spring 60 provides interlock function between the handle operator and the enclosure to prevent a hinged door (not shown) from opening when the operator is in the ON position. The auxiliary breaker 58 which is depicted in the ON condition, has its associated handle 58A trapped within the other pair of angulated upstanding posts 39A, 39B although only one such upright post 39A is shown. The manual operator 30 is similar to that described in the aforementioned U.S. Pat. No. 3,206,585, which patent should be referred to for a good description of the assembly and operation of the handle operator components.

A universal interlock arrangement has herein been described that effectively interlocks electric circuit breakers or electric switches, per se, or when controlled by a motor operator as well as by a handle operator.

Having thus described my invention, what I claim as new and desire to secure by Letters Patent is:

1. An interlock for electric circuit breakers and switches comprising:

a metallic base plate;

a pair of U-shaped top pieces attached to said base plate and spaced apart from each other to define an operating region on a surface of said base plate between said U-shaped top pieces;

a corresponding pair of planar latches, each latch being slidably arranged under one of said top pieces;

a corresponding first pair of upright posts attached to said latches each of said posts extending in a plane perpendicular to said base plate, and being captured within an elongated slot formed within each of said top pieces; and a trapezoidal lever slidably arranged on said base plate within said operating region for transferring in and out of abutment with said latches, one of said latches and an associated one of said posts being refrained from movement within an associated one of said slots when the other of said latches is in abutment with said trapezoidal lever.

2. The interlock of claim 1 wherein said trapezoidal lever comprises a planar base edge with a pair of opposing planar side edges extending perpendicular therefrom, a corresponding pair of angular side edges extending from said planar side edges, said angular side edges tapering towards each other, and a planar top edge extending opposingly parallel to said planar base edge.

3. The interlock of claim 2 wherein said latches each comprise a metal plate having an angular projection extending therefrom and a planar surface at a forward end of said angular projection, whereby said angular projection obstructs movement of said trapezoidal lever by contacting one of said angular side edges.

4. The interlock of claim 3 wherein each of said U-spaced top pieces is spaced from said base plate to define a clearance space between a bottom surface on each of said top pieces and a top surface on said base plate, one of said latches being slidably supported within said clearance space.

5. The interlock of claim 1 further including a pair of outer radial guides on said base plate each of said radial guides abutting and overlapping a part of said trapezoidal lever on one side.

6. The interlock of claim 5 including an elongated slot formed within said trapezoidal lever and, further including an inner radial guide on said base plate extending through said elongated slot, said inner radial guide abutting and overlapping a part of said elongated slot thereby controlling directional displacement of said trapezoidal lever in cooperation with said pair of outer radial guides.

7. The interlock of claim 1 wherein each of said latches further include a second upright post spaced apart from said first upright post to define an operating handle receiving space intermediate said first upright post and said second upright post.

8. The interlock of claim 1 wherein each of said first upright posts is angulated at one end thereof.

9. The interlock of claim 1 including a U-shaped bracket attached to a bottom surface of said base plate.

10. The interlock of claim 9 including a pair of U-shaped legs depending from said bracket, said legs being apertured for receiving means for fastening said interlock to an underlying circuit breaker or electric switch.

11. The interlock of claim 10 wherein said base plate further includes a slot on an outer edge thereon for providing access to a hand tool for attaching said fastening means.

* * * * *